US011911875B2

(12) United States Patent
Ferronato

(10) Patent No.: US 11,911,875 B2
(45) Date of Patent: Feb. 27, 2024

(54) FLEXIBLE ABRASIVE MEMBER HAVING ELONGATED DEPOSITS

(71) Applicant: KGS DIAMOND AG, Stans (CH)

(72) Inventor: Sandro Giovanni Giuseppe Ferronato, Dubai (AE)

(73) Assignee: KGS DIAMOND AG, Hergiswil NW (CH)

( * ) Notice: Subject to any disclaimer, the term of this patent is extended or adjusted under 35 U.S.C. 154(b) by 764 days.

(21) Appl. No.: 16/640,746

(22) PCT Filed: Aug. 21, 2017

(86) PCT No.: PCT/EP2017/071041
§ 371 (c)(1),
(2) Date: Feb. 21, 2020

(87) PCT Pub. No.: WO2019/037832
PCT Pub. Date: Feb. 28, 2019

(65) Prior Publication Data

US 2020/0198096 A1 Jun. 25, 2020

(51) Int. Cl.

| | |
|---|---|
| ***B24D 11/00*** | (2006.01) |
| ***B24D 3/00*** | (2006.01) |
| ***B24D 3/06*** | (2006.01) |
| ***B24D 3/28*** | (2006.01) |
| ***B24D 18/00*** | (2006.01) |

(52) U.S. Cl.
CPC ..... *B24D 11/001* (2013.01); *B24D 3/06* (2013.01); *B24D 3/004* (2013.01); *B24D 3/28* (2013.01); *B24D 18/00* (2013.01); *B24D 2203/00* (2013.01)

(58) Field of Classification Search
None
See application file for complete search history.

(56) References Cited

U.S. PATENT DOCUMENTS

| | | | | |
|---|---|---|---|---|
| 5,250,084 | A | 10/1993 | Lansell et al. | |
| 2015/0290771 | A1* | 10/2015 | Li | B24D 3/06 51/297 |
| 2016/0001423 | A1* | 1/2016 | Esteban | B24B 37/245 451/527 |

FOREIGN PATENT DOCUMENTS

| | | | | |
|---|---|---|---|---|
| WO | 97/47434 | A1 | 12/1997 | |
| WO | 2015/168229 | A1 | 11/2015 | |
| WO | WO-2015168229 | A1 * | 11/2015 | B24D 11/001 |

* cited by examiner

*Primary Examiner* — James A Fiorito
*Assistant Examiner* — Ross J Christie
(74) *Attorney, Agent, or Firm* — N.V. Nederlandsch Octrooibureau

(57) ABSTRACT

A flexible abrasive member including a substrate, which carries an array of deposits with embedded abrasive particles, where each deposit has an elongated continuous structure that extends along a center trajectory predominantly in a longitudinal direction across the substrate. The structure has inset portions and recessed portions, which protrude oppositely along a transverse directions from the center trajectory. The inset portions of a deposit are accommodated in the recessed portions of a transversely preceding deposit, and the recessed portions of the deposit accommodate the inset portions of a transversely following deposit, so that the inset portions and recessed portions of neighboring deposits mutually overlap in said transverse directions.

19 Claims, 2 Drawing Sheets

FLEXIBLE ABRASIVE MEMBER HAVING ELONGATED DEPOSITS

TECHNICAL FIELD

The invention relates to a flexible abrasive member comprising a substrate which carries deposits with embedded abrasive particles, and to a belt, disc, sheet, cylinder, reamer, or block comprising such a flexible abrasive member. Furthermore, the invention relates to method for manufacturing such flexible abrasive members.

BACKGROUND ART

Such a flexible abrasive member is generally known and can be used for various kinds of grinding or polishing operations. Such operations may include the treatment of stone, marble, or wooden objects, such as floors, furniture and the like. Also the treatment of glass and the like is possible, for instance for working the edges of a glass panel. Grinding or polishing treatment may also be performed on metals (e.g. aluminum, titanium, steel), ceramics (e.g. tungsten carbide), composites, other rock types (e.g. granite), etc. Depending on the product to be treated, the flexible abrasive member may be applied in the form of a belt, a block, a disc, a sheet, a cylinder, or a reamer.

An example of a flexible abrasive member is described in EP-A-910496. This known flexible member has certain advantages both with respect to useful life, the quality of the polishing and grinding process and the production time required. Nevertheless further improvements are desirable.

Furthermore, various methods are known for manufacturing flexible abrasive members, such as electroplating, electroless plating, gas deposition, sintering, or screening by using resin. A well-known and preferred method is electroplating, which allows a mixture of metal particles and abrasive particles to be electro-deposited on a metallized screen. Presently known deposit patterns may exhibit a less than optimum distribution of the metal and abrasive particles.

It would be desirable to provide a flexible abrasive member which offers the possibility to obtain a higher production output while avoiding a higher production time. It may also be desirable to provide a flexible abrasive member which offers a stronger and/or more aggressive polishing and/or grinding action, without undue extension of production time. It may further be desirable to provide a flexible abrasive member which allows a more efficient way of manufacturing a deposit pattern with regularly distributed metal particles and abrasive particles.

SUMMARY OF INVENTION

Therefore, according to a first aspect of the invention, there is provided a flexible abrasive member comprising a substrate, which carries a plurality of deposits with embedded abrasive particles. Each deposit has an elongated continuous structure that extends along a center trajectory predominantly in a longitudinal direction X across the substrate. The structure of a deposit comprises inset portions and recessed portions, which protrude in opposite transverse directions from the center trajectory. The inset portions of a deposit are accommodated in recessed portions of a preceding deposit, and the recessed portions of the deposit accommodate inset portions of a following deposit, so that the inset portions and recessed portions of neighboring deposits mutually overlap in said transverse directions.

The pattern of elongated continuous structures has several advantages. It provides an increased mechanical strength to the flexible abrasive member which results from the interlocking portions. These parts protect the porous layer against extreme deformations which otherwise may occur under the loads exerted between the flexible abrasive member and the object under treatment.

In the flexible abrasive members according to this aspect, the substrate surface is associated with longitudinal and transverse directions X, Y. The transverse direction Y preferably corresponds to the direction in which the substrate of the abrasive member is to be tensioned or otherwise subjected to force, in order to cause motion relative to the object to be treated (e.g. ground or polished). The overlap of inset portions and recessed portions of neighboring deposits implies that (at least part of) the inset and recessed portions extend along each other in the transverse directions ±Y, and partly cover each other if viewed along the longitudinal direction X. This does not necessarily imply that the inset and recessed portions are in direct physical contact. Instead, the mutually overlapping inset and recessed portions may be spaced along the longitudinal direction X by an intermediate void (or by a structure of a different material). Due to the overlapping arrangement of inset and recessed portions of neighboring deposits, the resistance against tearing of the porous layer is increased as well.

Furthermore, the relatively long dimensions of the deposits or elongated structures have a favorable influence on heat dissipation. In use heat is generated due to frictional forces between the flexible abrasive member and the object; the heat which is locally generated is dissipated via the elongated structures thus avoiding overheating and deterioration of the flexible abrasive member.

The deposits may be arranged on the substrate in various ways. According to a preferred embodiment, each deposit extends up to at least one of opposite boundaries of the porous layer. More preferably, each deposit extends up to two opposite boundaries of the porous layer. Such arrangement is useful in case the deposits are obtained through electro-deposition, as will be addressed below.

In embodiments, the center trajectories of the elongated deposit structures are linear and correspond to longitudinal axes that extend mutually parallel across the substrate. Preferably, the center trajectories of all deposits are parallel to each other.

The inset portions and recessed portions of the elongated structures may have any desirable shape, such an undulating shape or an angular shape. Preference is given to an embodiment wherein the elongated structure of each deposit comprises transverse segments, which extend with a substantial component or entirely along the transverse directions, and which are mutually spaced in the longitudinal and transverse directions. The transverse segments may be parallel to each other, and perpendicular to the longitudinal direction.

The transverse segments form successive portions of the elongated structure of a deposit. The successive transverse segments may be interconnected via oblique segments, so that the deposit forms a piecewise linear structure.

The transverse segments may have local widths W that are substantially identical. The oblique segments may also have identical local widths W, so that the deposit forms a piecewise linear strip-shaped structure that has a uniform width W along the entire structure.

In embodiments, the inset portion comprises a first pair of transverse segments that extend alongside each other to protrude from one side of the center trajectory. This first pair of transverse segments jointly define an external dimension along the longitudinal direction. In addition, the recessed portion may comprise a second pair of transverse segments that extend alongside each to protrude from an opposite side of the center trajectory. This second pair of transverse segments are mutually spaced along the longitudinal direction over an internal dimension that is larger than the external dimension.

The deposits are nested into each other by virtue of their meandering (e.g. undulated, seesaw, or zigzag) shape. This arrangement results in a greatly enhanced stability of the flexible abrasive member, even under high loadings and temperatures.

In embodiments, an inset portion and a recessed portion of one deposit jointly form a unit cell. The elongated structure of each deposit may then comprises a periodic sequence of such unit cells that are interconnected and extend along the center trajectory. Such unit cells may for instance be formed by a piecewise linear sequence of interconnected linear deposit segments. To improve the tearing strength of such abrasive member in the transverse direction Y, all these line segments preferably extend with a non-zero component along the transverse direction Y.

In a further embodiment, the unit cell extends with a unit length $\Delta Xu$ along the longitudinal direction. Adjacent distal segments of two subsequent recess portions of a deposit may then jointly form a further inset portion that is congruent to an inset portion, so that the sequence of unit cells is symmetric over a transformation that consists of (i) a 180° rotation of the sequence about the nominal axis and a translation of the sequence over half a cell length $\frac{1}{2}\cdot\Delta Xu$ along the nominal axis, or of (ii) a reflection of the sequence with respect to the nominal axis and a translation of the sequence over half a cell length along the nominal axis.

An inset portion of a deposit and an inset portion of a following deposit may jointly border a void from longitudinal and transverse directions. The substrate is exposed through such a void, which may contribute to improved cooling rates during grinding or polishing operations. Different sizes (i.e. surface areas) of the voids may be selected to achieve desired cooling rates and/or grinding/polishing rates.

Alternatively, the inset portion may form a first transverse tongue segment, which protrudes on one side from the center trajectory and has an external dimension along the longitudinal direction. In addition, the recessed portion may be formed between two second transverse tongue segments, which protrude on an opposite side from the center trajectory, and are mutually spaced along the longitudinal direction over an internal dimension that is larger than the external dimension.

The tongue segments form continuous patches of (abrasive) deposit material. These continuous patches may help to prolong the technical lifespan of the abrasive member. In addition, use of an abrasive member with tongue segments including fine grit abrasive particles may yield improved finishing of a treated product.

The first tongue segments and second tongue segments may have congruent shapes. Alternatively or in addition, the first tongue segments may be interconnected with the second tongue segments via medial oblique segments.

The flexible abrasive member may be manufactured in several ways, as mentioned before. Preference is given to a manufacturing process based on electrodeposition. In that case, the substrate may comprise a porous layer (such as a metallized wire mesh), and the deposits may be formed by electrodeposition of metal (e.g. nickel) containing abrasive particles (e.g. diamond particles). The elongated structures lend themselves in particular for an efficient application of electric current and voltage distribution, whereby the electro-deposition process is enhanced. As an example, the metallized wire mesh and the metal deposition comprise nickel. Another manufacturing process may be based on automated liquid resin deposition deposited on fabrics, like woven fabrics or non-woven fabrics made from e.g. cotton or polyester.

According to further aspects, there is provided a belt, a disc, a sheet, a cylinder, a reamer, or a block for carrying out a grinding and/or polishing process, wherein the belt, disc, sheet, cylinder, reamer, or block comprises a flexible abrasive member in accordance with the first aspect.

BRIEF DESCRIPTION OF DRAWINGS

Embodiments will now be described, by way of example only, with reference to the accompanying schematic drawings in which corresponding reference symbols indicate corresponding parts. In the drawings, like numerals designate like elements. Multiple instances of an element may each include separate letters appended to the reference number. For example, two instances of a particular element "20" may be labeled as "20*a*" and "20*b*". The reference number may be used without an appended letter (e.g. "20") to generally refer to an unspecified instance or to all instances of that element, while the reference number will include an appended letter (e.g. "20*a*") to refer to a specific instance of the element.

The figures are meant for illustrative purposes only, and do not serve as restriction of the scope or the protection as laid down by the claims.

DESCRIPTION OF EMBODIMENTS

The following is a description of certain embodiments of the invention, given by way of example only and with reference to the figures.

Figure 1:
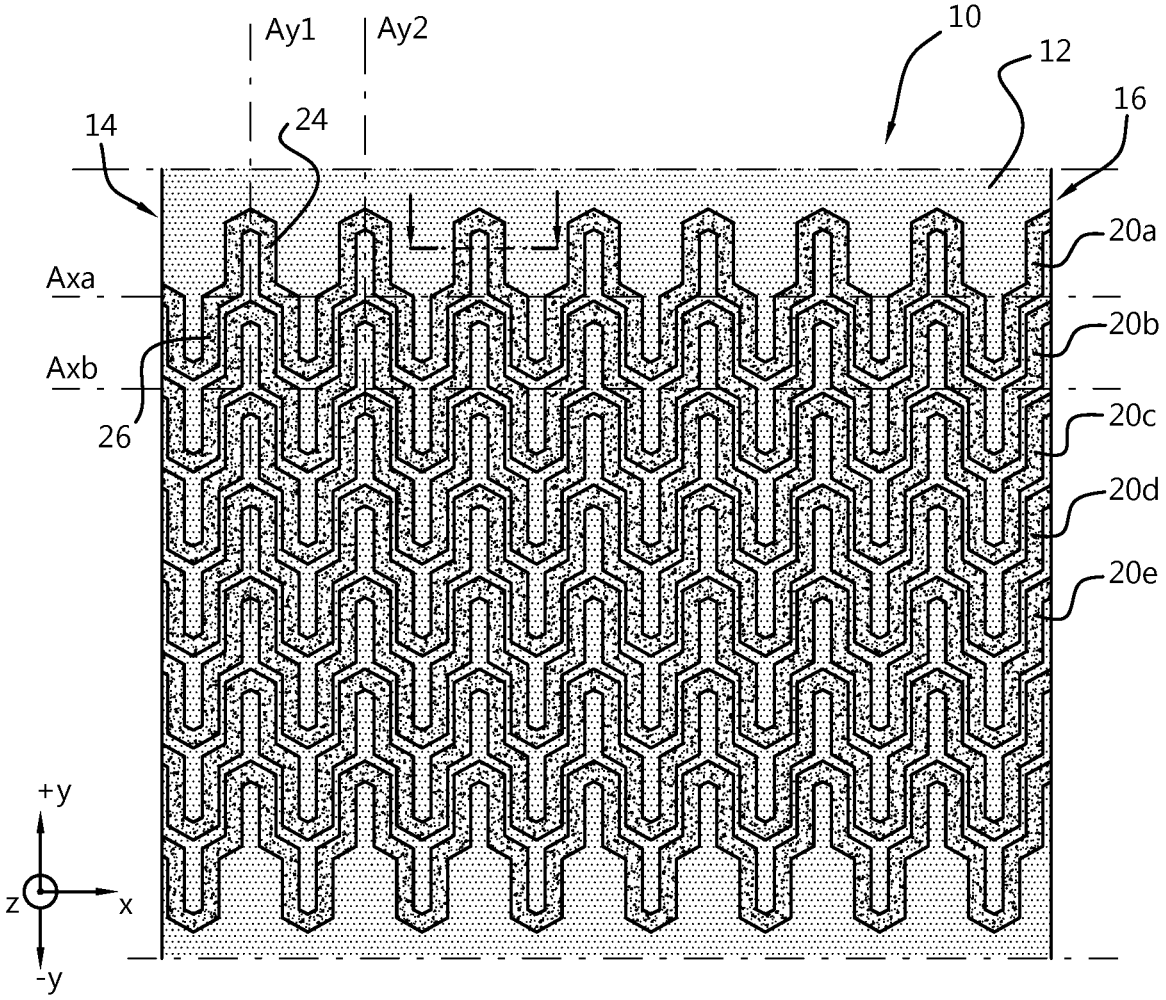
FIG. 1 shows a top view of the abrasive member according to an embodiment.
Figure 2:
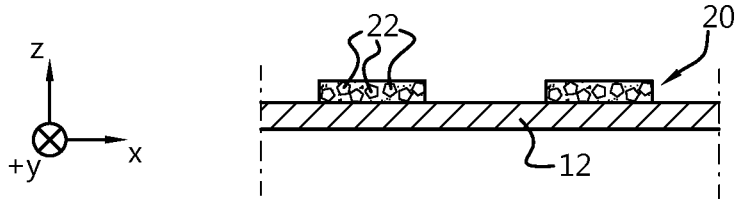
FIG. 2 shows a cross-sectional side view of a portion of the abrasive member according to II in FIG. 1.
Figure 3:
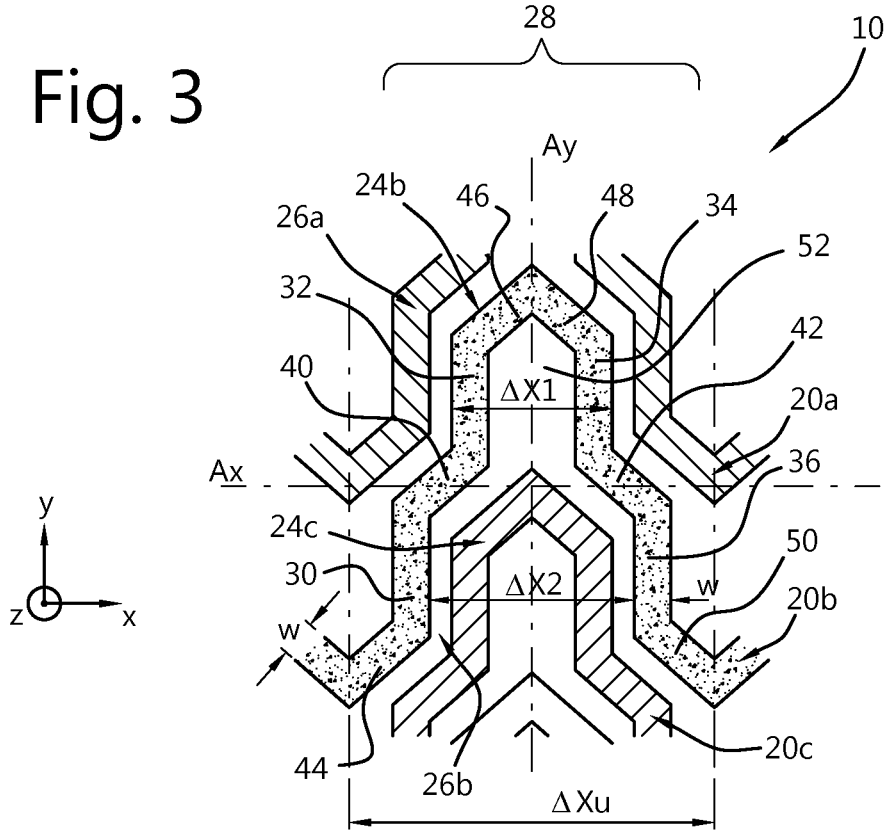
FIG. 3 shows a top view of a portion of the abrasive member according to FIG. 1.

The flexible abrasive member 10 according to FIGS. 1-3 has a substrate 12 in the form of the porous layer, which can be carried out as a wire mesh. This wire mesh may be formed of a plastic coated with a metal such as nickel. By means of electrodeposition, a mixture of metal and abrasive particles and metal particles 22 can be deposed onto the porous layer 12. Thereby, deposits 20*a*, 20*b*, 20*c*, 20*d*, 20*e*, etc. are formed, which include metal and abrasive particles 22 embedded therein. FIG. 1 shows a top view of the abrasive member 10, along a normal direction Z and onto the substrate 12 that extends along a longitudinal direction X and a transverse direction Y. FIG. 2 depicts a cross-sectional side view of a portion of the abrasive member 10 according to section II in FIG. 1, corresponding with a sectional plane along the longitudinal and normal directions X, Z.

As shown in FIGS. 1 and 3, each of the deposits 20 has a continuous elongated structure. In this exemplary embodiment, the deposits 20 extend in a meandering way between and up to the two opposite boundaries 14, 16 of the porous layer 12. Each deposit 20 extends in the longitudinal direction X along an associated nominal center axis Ax, and has a piecewise-linear meandering shape that is centered on its axis Ax. Each deposit 20 is separated at least in the longitudinal direction X from each of its adjacent two deposits by a non-zero inter-deposit spacing, which is in the order of millimeters or less.

Each deposit 20 comprises a plurality of inset portions 24 and recessed portions 26, which protrude in opposite transverse directions ±Y from the center axis Ax. The inset portions $\mathbf{24}_i$ of a specific deposit $\mathbf{20}_i$ (i=b, c, d, . . . ) are accommodated in aligned recessed portions $\mathbf{26}_{i-1}$ of a preceding deposit $\mathbf{20}_{i-1}$ (i−1=a, b, c, . . . ). Similarly, the recessed portions $\mathbf{26}_i$ of this specific deposit $\mathbf{20}_i$ accommodate inset portions $\mathbf{24}_{i+1}$ of a following deposit $\mathbf{20}_{i+1}$ (i+1=c, d, e, . . . ). The adjacent inset and recessed portions 24, 26 of all neighboring deposits 20 are arranged in this interlocking manner. As a result, the inset portions 24 and recessed portions 26 of neighboring deposits 20 mutually overlap in the transverse directions ±Y.

FIG. 3 shows a top view of a portion of the exemplary abrasive member 10 from FIGS. 1-2 in more detail. In this example, the elongated structure of each deposit 20 comprises transverse segments 30, 32, 34, 36 and oblique segments 40, 42, 44, 46, 48, 50, which jointly form a piecewise linear structure. The transverse segments 30-36 and the oblique segments 40-50 have local widths W that are substantially identical. The transverse segments 30-36 and oblique segments 40-50 of each elongated structure 20 form the inset portions 24 and the recessed portions 26 mentioned above. The inset portions 24 and recessed portions 26 of each deposit 20 protrude in opposite transverse directions ±Y away from the center axis Ax of this deposit 20, and in this example upwards and downwards respectively. It should be understood that the directional definitions and orientations presented herein merely serve to elucidate geometrical relations for specific embodiments. Directional terms in the specification and claims (e.g. "upwards" and "downwards") are used herein solely to indicate relative directions and are not otherwise intended to limit the scope of the invention or claims.

As illustrated in FIG. 3, an inset portion 24*b* and a recessed portion 26*b* of one deposit 20*b* jointly form a unit cell 28. The unit cell 28 spans over a unit length ΔXu along the longitudinal direction X. The unit cells 28 of the deposit 20*b* are interconnected and extend along the center axis Ax, to form a periodic sequence of unit cells.

The inset portion 24*b* comprises a first pair of transverse segments 32, 34, which extend alongside each other and along the positive transverse direction +Y, and protrude upwards away from the center axis Ax. The first transverse segments 32, 34 jointly define an external dimension ΔX1 along the longitudinal direction X. The recessed portion 26*b* comprises a second pair of transverse segments 30, 36, which extend alongside each other and along the negative transverse direction −Y, and protrude downwards away from the center axis Ax. The second transverse segments 30, 36 are mutually spaced along the longitudinal direction X over an internal dimension ΔX2. This internal dimension ΔX2 is larger than the external dimension ΔX1 of the first transverse segments 32, 34. This allows an inset portion 24*c* of a following deposit 20*c* to be accommodated in the recessed portion 26*b* of this one deposit 20*b*, with a mutual overlap along the transverse direction Y. A non-zero inter-deposit spacing along the longitudinal direction X, which is defined between the first transverse segment 34 of deposit 20*b* and a second transverse segment 36 of deposit 20*a*, and which can be associated with a distance ½·(ΔX2−ΔX1), is in the order of millimeters or less. Similar non-zero inter-deposit spacings are defined between other first and second transverse segments of directly adjacent deposits.

By forming all unit cells and all deposits 20 in the same manner, al inset and recessed portions of neighboring deposits 20 can be accommodated in similar overlapping manner. In alternative embodiments, the inset portions and/or recessed portions may be formed by more than two transverse segments Successive transverse segments 30-36 are pair-wise interconnected via the oblique segments 40-50, to form the meandering piece-wise linear structure. Each of the first transverse segments 32, 34 is connected to one of a second transverse segment 30, 36 via a first medial segment 40 or a second medial segment 42. The medial segments 40, 42 extend obliquely to the longitudinal and transverse directions X, Y and cross the center axis Ax.

The first transverse segments 32, 34 are mutually interconnected via distal segments 44, 46, 48, 50, which also extend obliquely to the longitudinal and transverse directions X, Y. A first distal segment 44 of the depicted unit cell is connected to a fourth distal oblique segment of a preceding unit cell. Similarly, the fourth distal oblique segment 50 of the depicted unit cell is connected to a first distal oblique segment of a following unit cell. The transverse segments 30, 36 and the oblique segments 44, 50 of subsequent recess portions 26 are thus interconnected, to jointly form lower inset portions that are congruent to the upper inset portions 24. The resulting sequence of unit cells is symmetric over a transformation that consists of a 180° rotation of the sequence about the center axis Ax and a translation of the sequence over half a cell length ½·ΔXu along the center axis Ax.

Each time, an inset portion 24*b* of a deposit 20*b* and an inset portion 24*c* of a following deposit 20*c* jointly border a void 52, viewed along the longitudinal and transverse directions X, Y. The substrate 12 is exposed via this void 52, if viewed along the normal direction Z.

Figure 4:
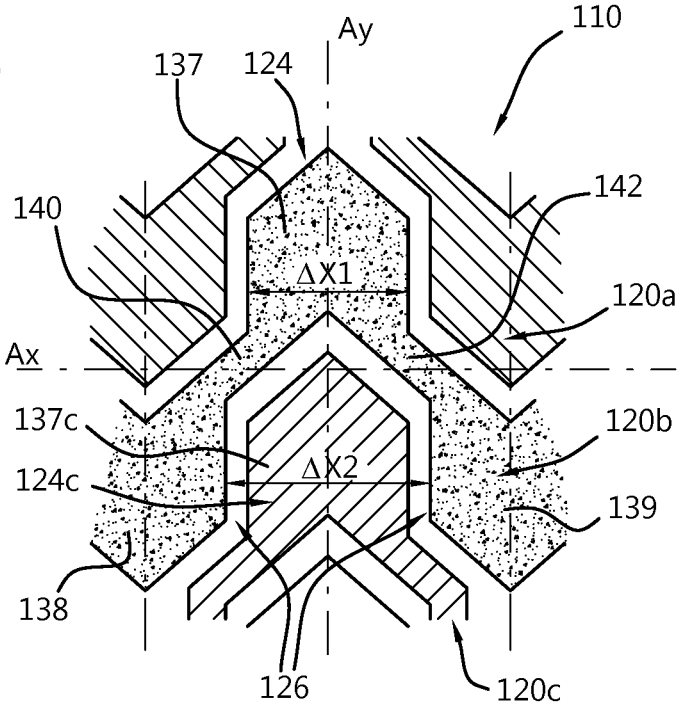
FIG. 4 shows a top view of a portion of an abrasive member according to an alternative embodiment.

FIG. 4 shows a top view of a portion of an alternative embodiment of a flexible abrasive member 110. Features that have already been described above with reference to the abrasive member 10 in FIGS. 1-3 may also be present in this abrasive member 110, and will not all be discussed here again. For the discussion with reference to FIG. 4, like features are designated with similar reference numerals preceded by 100 to distinguish the embodiments.

The inset portions 124 of this flexible abrasive member 110 comprises first transverse tongue segments 137 that protrude on an upper side from the center axis Ax. Each first tongue segment 137 forms a continuous patch of deposit material including metal and abrasive particles, and has an external dimension ΔX1 along the longitudinal direction X. Recessed portions 126 are each formed between two subsequent second transverse tongue segments 138, 139. The second tongue segments 138, 139 also form continuous patches, and protrude on a lower side from the center axis Ax. The second tongue segments 138, 139 are mutually spaced along the longitudinal direction X over an internal dimension ΔX2 that is larger than the external dimension ΔX1, to accommodate an adjacent first tongue segment 137*c* of a following deposit 120*c*.

The first tongue segments 137 and second tongue segments 138, 139 have congruent shapes, and are pair-wise interconnected via medial oblique segments 140, 142 to form a continuous deposit 120. The resulting sequence of unit cells in each deposit 120 is again symmetric over a transformation that consists of a 180° rotation of the sequence about the center axis Ax and a translation of the sequence over half a cell length ½·ΔXu along the center axis Ax.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. It will be apparent to the person skilled in the art that alternative and equivalent embodiments of the invention can be conceived and reduced to practice. All changes which come within the meaning and range of equivalency of the claims are to be embraced within their scope.

LIST OF REFERENCE SYMBOLS

Similar reference numbers that have been used in the description to indicate similar elements (but differing only in the hundreds) should be considered implicitly included.

10 flexible abrasive member
12 substrate
14 first substrate boundary
16 second substrate boundary
20 deposit
22 abrasive particle
24 inset portion
26 recessed portion
28 unit cell
30 first transverse segment
32 second transverse segment
34 third transverse segment
36 fourth transverse segment
40 first medial oblique segment
42 second medial oblique segment
44 first distal oblique segment
46 second distal oblique segment
48 third distal oblique segment
50 fourth distal oblique segment
52 void
137 first tongue segment
138 second tongue segment
139 further second tongue segment
Ax center trajectory (e.g. longitudinal axis)
Ay transverse axis
X first direction (longitudinal direction)
Y second direction (transverse direction)
Z third direction (out-of-substrate i.e. normal direction)
ΔXu unit cell length
ΔX1 inset extent (external dimension)
ΔX2 recess extent (internal dimension)
W deposit width

The invention claimed is:

1. A flexible abrasive member, comprising a substrate, which carries a plurality of deposits with embedded abrasive particles, wherein each deposit has an elongated continuous structure that extends along a center trajectory predominantly in a longitudinal direction across the substrate;

wherein said structure comprises inset portions and recessed portions, which protrude in opposite transverse directions from the center trajectory;

wherein the inset portions of a deposit are accommodated in recessed portions of a preceding deposit, and the recessed portions of the deposit accommodate inset portions of a following deposit, so that the inset portions and recessed portions of neighboring deposits mutually overlap in said transverse directions, and wherein the elongated structure of each deposit comprises transverse segments which extend along the transverse directions and are mutually spaced in the longitudinal and transverse directions.

2. The flexible abrasive member according to claim 1, wherein each deposit extends up to two opposite boundaries of the substrate.

3. The flexible abrasive member according to claim 1, wherein the center trajectories are linear and correspond to longitudinal axes that extend mutually parallel across the substrate.

4. The flexible abrasive member according to claim 1, wherein an inset portion and a recessed portion of one deposit jointly form a unit cell, and wherein the elongated structure of each deposit comprises a periodic sequence of such unit cells that are interconnected and extend along the center trajectory.

5. The flexible abrasive member according to claim 4, wherein the unit cell extends with a unit length along the longitudinal direction, and wherein adjacent distal segments of two subsequent recess portions of a deposit jointly form a further inset portion that is congruent to an inset portion, so that the sequence of unit cells is symmetric over a transformation that consists of:

a 180° rotation of the sequence about the nominal axis and a translation of the sequence over half a cell length along the nominal axis, or of a reflection of the sequence with respect to the nominal axis and a translation of the sequence over half a cell length along the nominal axis.

6. The flexible abrasive member according to claim 1, wherein the inset portion comprises a first pair of transverse segments that extend alongside each other to protrude from one side of the center trajectory, and which jointly define an external dimension along the longitudinal direction, and wherein the recessed portion comprises a second pair of transverse segments that extend alongside each other to protrude from an opposite side of the center trajectory, and which are mutually spaced along the longitudinal direction over an internal dimension that is larger than the external dimension.

7. The flexible abrasive member according to claim 1, wherein the transverse segments are mutually parallel and perpendicular to the longitudinal direction.

8. The flexible abrasive member according to claim 1, wherein the transverse segments form successive portions of the elongated structure of a deposit, and wherein successive transverse segments are mutually interconnected via oblique segments, so that the deposit forms a piecewise linear structure.

9. The flexible abrasive member according to claim 1, wherein the transverse segments have local widths that are substantially identical, or wherein the transverse segments and oblique segments have local widths that are substantially identical.

10. The flexible abrasive member according to claim 1, wherein an inset portion of a deposit and an inset portion of a following deposit jointly border a void with an exposed portion of the substrate from the longitudinal and transverse directions.

11. The flexible abrasive member according to claim 1, wherein the inset portion comprises a first transverse tongue segment which protrudes on one side from the center trajectory and has an external dimension along the longitudinal direction, and wherein the recessed portion is formed between two second transverse tongue segments which protrude on an opposite side from the center trajectory, and are mutually spaced along the longitudinal direction over an internal dimension that is larger than the external dimension.

12. The flexible abrasive member according to claim 11, wherein the first tongue segments and second tongue segments have congruent shapes, and the first tongue segments are interconnected with the second tongue segments via medial oblique segments.

13. The flexible abrasive member according to claim 1, wherein the deposits have an undulating shape, a seesaw shape, or a zigzag shape.

14. The flexible abrasive member according to claim 1, wherein the substrate comprises a porous layer.

15. The flexible abrasive member according to claim 14, wherein the porous layer comprises a metallized wire mesh and the deposits comprise a deposition of metal containing abrasive particles.

16. The flexible abrasive member according to claim 15, wherein the metallized wire mesh and the metal deposition comprise nickel.

17. A belt, disc, sheet, cylinder, reamer, or block for carrying out a grinding or polishing process, and comprising the flexible abrasive member according to claim 1.

18. A method for manufacturing a flexible abrasive member comprising a substrate carrying a plurality of deposits with embedded abrasive particles, each deposit having an elongated continuous structure that extends along a center trajectory predominantly in a longitudinal direction across the substrate, said structure comprising inset portions and recessed portions that protrude in opposite transverse directions from the center trajectory, wherein the inset portions of a deposit are accommodated in recessed portions of a preceding deposit, and the recessed portions of the deposit accommodate inset portions of a following deposit, so that the inset portions and recessed portions of neighboring deposits mutually overlap in said transverse directions, wherein the elongated structure of each deposit comprises transverse segments which extend along the transverse directions and are mutually spaced in the longitudinal and transverse directions, and wherein the method comprises:

providing a substrate formed by a metallized wire mesh, and applying onto the substrate a plurality of film structures of electrically conductive material and having shapes corresponding to the elongated structures of the deposits;

forming the deposits with embedded abrasive particles onto the structured films via electrodeposition.

19. A method for manufacturing a flexible abrasive member comprising a substrate carrying a plurality of deposits with embedded abrasive particles, each deposit having an elongated continuous structure that extends along a center trajectory predominantly in a longitudinal direction across the substrate, said structure comprising inset portions and recessed portions that protrude in opposite transverse directions from the center trajectory, wherein the inset portions of a deposit are accommodated in recessed portions of a preceding deposit, and the recessed portions of the deposit accommodate inset portions of a following deposit, so that the inset portions and recessed portions of neighboring deposits mutually overlap in said transverse directions, wherein the elongate structure of each deposit comprises transverse segments which extend along the transverse directions and are mutually spaced in the longitudinal and transverse directions, and wherein the method comprises:

providing a substrate formed by a fabric;

forming the deposits with embedded abrasive particles onto the substrate via liquid resin deposition.

* * * * *